US006772685B2

(12) United States Patent
Schaffrath

(10) Patent No.: US 6,772,685 B2
(45) Date of Patent: Aug. 10, 2004

(54) COMBINATION OF A DISTRIBUTOR ROLLER OF A PRINTING MACHINE AND A TRAVERSING MECHANISM THEREFOR, INKING UNIT AND PRINTING PRESS HAVING THE COMBINATION

(75) Inventor: Dieter Schaffrath, Lorsch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/281,029

(22) Filed: Oct. 25, 2002

(65) Prior Publication Data

US 2003/0079632 A1 May 1, 2003

(30) Foreign Application Priority Data

Oct. 25, 2001 (DE) ..... 101 52 845
Jun. 19, 2002 (DE) ..... 102 27 516

(51) Int. Cl.[7] ..... B41F 31/15

(52) U.S. Cl. ..... 101/352.06; 101/DIG. 38; 101/350.3; 492/15; 74/89.14

(58) Field of Search ..... 101/DIG. 38, 350.3, 101/352.06, 348; 74/424.6, 89.14, 22 R; 492/15, 18

(56) References Cited

U.S. PATENT DOCUMENTS

| | | | | |
|---|---|---|---|---|
| 378,344 A | * | 2/1888 | Thompson | 74/22 R |
| 2,040,331 A | | 5/1936 | Peyrebrune | |
| 3,389,449 A | * | 6/1968 | Fyfe | 492/15 |
| 4,509,426 A | | 4/1985 | Hardin | |
| 4,711,171 A | | 12/1987 | Theilacker | |
| 5,054,393 A | * | 10/1991 | MacPhee | 101/348 |
| 5,154,092 A | * | 10/1992 | MacPhee | 74/425 |
| 5,191,835 A | | 3/1993 | Blanchard | |
| 5,415,095 A | | 5/1995 | Rennerfelt | |

FOREIGN PATENT DOCUMENTS

| | | |
|---|---|---|
| DE | 1 910 159 | 10/1969 |
| DE | 2 045 717 | 3/1972 |
| DE | 35 40 912 A1 | 5/1987 |
| DE | 692 12 056 T2 | 10/1992 |
| DE | 100 14 853 A1 | 10/2001 |
| EP | 0 462 490 B2 | 12/1991 |
| EP | 0 510 962 B1 | 10/1992 |
| EP | 0 607 283 B1 | 7/1994 |
| GB | 1 255 737 | 12/1971 |
| JP | 2 946 234 | 7/1999 |

* cited by examiner

*Primary Examiner*—Andrew H. Hirshfeld
*Assistant Examiner*—Leo T. Hinze
(74) *Attorney, Agent, or Firm*—Laurence A. Greenberg; Werner H. Stemer; Ralph E. Locher

(57) ABSTRACT

A combination of a distributor roller of a printing machine and a traversing mechanism for the distributor roller, includes worm gearing with an externally toothed worm and a worm wheel meshing therewith. The worm gearing is disposed in the distributor roller. The invention also includes an inking unit of a printing machine, which has the combination as well as a printing press having the combination.

12 Claims, 3 Drawing Sheets

COMBINATION OF A DISTRIBUTOR ROLLER OF A PRINTING MACHINE AND A TRAVERSING MECHANISM THEREFOR, INKING UNIT AND PRINTING PRESS HAVING THE COMBINATION

BACKGROUND OF THE INVENTION

Field of the Invention

The invention relates to a combination of a distributor roller of a printing machine and a traversing mechanism therefor which includes a worm gear with an externally toothed worm, and a worm wheel. The invention also relates to an inking unit and a printing press having the combination.

Such a traversing mechanism serves for moving the distributor roller reciprocatingly in axial direction thereof, in order to equalize or make a printing-ink or dampening-medium film uniform.

A traversing mechanism corresponding to the general type thereof described in the introduction hereto has become known heretofore, for example in European Patent EP 0 462 490 B2, corresponding to U.S. Pat. No. 5,191,835. In that traversing mechanism, the worm is externally toothed, and the worm gear is disposed near the distributor roller.

The compactness of the traversing mechanism is insufficient for specific application areas.

German Translation DE 692 12 056 T2 of European Patent EP 0 510 962 B1 describes a traversing mechanism, which does not correspond to the general type mentioned in the introduction hereto, for a distributor roller of a printing machine. That traversing mechanism includes a worm gear disposed in the distributor roller and having an internally toothed worm. The manufacture of the internal toothing of the worm is comparatively complicated.

More remote prior art is described in U.S. Pat. Nos. 2,040,331, in 4,509,426 and in Japanese Patent 29 46 234.

SUMMARY OF THE INVENTION

It is accordingly an object of the invention to provide a combination of a distributor roller of a printing machine and a traversing mechanism therefor as well as an inking unit and a printing press having the combination, which overcome the hereinafore-mentioned disadvantages of the heretofore-known devices of this general type and which are simultaneously suitable for manufacture and particularly space-saving.

With the foregoing and other objects in view, there is provided, in accordance with the invention, in combination with a distributor roller of a printing machine, a traversing mechanism for the distributor roller, comprising worm gearing having an externally toothed worm and a worm wheel meshing therewith. The worm gearing is disposed in the distributor roller.

In accordance with another feature of the invention, the worm is disposed axially parallel to the distributor roller.

In accordance with a further feature of the invention, the combination further includes a planetary gear mechanism disposed in the distributor roller.

In accordance with an added feature of the invention, the planetary gear mechanism is a single-stage spur-wheel planetary gear mechanism.

In accordance with an additional feature of the invention, the worm wheel is mounted for rotation about the worm.

In accordance with yet another feature of the invention, the combination further includes a crank mechanism having a crank disposed in the distributor roller.

In accordance with yet a further feature of the invention, the crank mechanism is a cross-slide crank mechanism.

In accordance with yet an added feature of the invention, the combination further includes a cross-slide crank mechanism coupled with the worm gearing in accordance with gearing technology.

In accordance with yet an additional feature of the invention, the combination further includes at least one stationary shaft. The distributor roller is rotatably mounted on the at least one stationary shaft.

In accordance with still another feature of the invention, the distributor roller is rotatively drivable by circumferential-surface friction.

In accordance with still a further feature of the invention, the distributor roller has at least one shaft. The worm and the worm wheel are mounted so as to be rotatable together about the at least one shaft.

With the objects of the invention in view, there is also provided an inking unit of a printing machine, comprising, in combination with an ink distributor roller, a traversing mechanism for the ink distributor roller. The traversing mechanism includes worm gearing having an externally toothed worm and a worm wheel meshing therewith. The worm gearing is disposed in the ink distributor roller.

With the objects of the invention in view, there is additionally provided a printing press, comprising, in combination with a distributor roller, a traversing mechanism for the distributor roller. The traversing mechanism includes worm gearing having an externally toothed worm and a worm wheel meshing therewith. The worm gearing is disposed in the distributor roller.

In the combination according to the invention, maximum compactness is achieved in that the worm gearing of the traversing mechanism is disposed within the distributor roller.

The construction space no longer required for accommodating the worm gearing next to the distributor roller in accordance with the prior art mentioned hereinabove is now available for other purposes. The integration of the worm gearing into the distributor roller is also advantageous with regard to maintenance of the distributor roller which is to be performed outside the printing machine. The distributor roller can be removed, together with the worm gearing disposed therewithin, from the printing machine and, after maintenance has taken place, can be re-inserted into the printing machine. The outlay in terms of demounting and mounting which maintenance entails is comparatively low, because the distributor roller does not, in this case, have to be separated from the worm gearing.

Further to achieving the advantages noted hereinabove, the external toothing of the worm affords favorable conditions for manufacturing the worm.

In a further development which is advantageous with respect to a distributor roller having a small diameter, and the integration of the worm gearing into this distributor roller having a small diameter, the worm of the worm gearing is disposed so that the wheel axis (geometric middle axis) about which the worm rotates is oriented parallel to a geometric middle axis about which the distributor roller rotates. Placing the worm away from the center of the distributor roller in this way makes it possible to dispose the worm wheel near the center. In this further development, the two gearwheels (worm, worm wheel) can be mounted so as to be rotatable together about at least one axis of the distributor roller.

In another development which is advantageous with respect to the rotary drive of the worm which, as described hereinaboveabove, is disposed eccentrically, a planetary gear, preferably a single-stage spur-wheel planetary gear, is likewise disposed in the distributor roller.

In a development which is advantageous with respect to a simple construction of the traversing mechanism requiring only a few parts, the worm wheel of the worm gearing is mounted so as to rotate around the worm. According to this development, the worm wheel thus rotates simultaneously about two geometric mid-axes or middle axes oriented perpendicularly to one another, more precisely about its own mid-axis and, together with the distributor roller, about the mid-axis or wheel axis of the worm.

In a development which is advantageous with respect to a conversion of a rotational movement of the worm gearing into a linear oscillation of the distributor roller, a crank of a crank mechanism, for example a cross-slide crank mechanism, connected to the worm gearing is disposed within the distributor roller. The crank may either be a component separate from the worm wheel, but connected to the worm wheel so as to be fixed against rotation relative thereto, or, if a crank pin is disposed directly on the worm wheel, be formed by the latter.

In a development which is advantageous with respect to a forcelocking or nonpositive-locking rotary drive of the distributor roller, the latter is mounted rotatably either on a single shaft so as to be fixed against rotation relative thereto or on two journal-like shafts disposed in alignment and fixed against relative rotation. The distributor roller mounted in this way can be driven rotatively exclusively via the friction between the circumferential surface thereof and a circumferential surface in rolling contact with the distributor roller, for example the circumferential surface of a printing form or of an applicator roller. In connection with the foregoing, a forcelocking connection is one which connects two elements together by force external to the elements, as opposed to a formlocking connection which is provided by the shapes of the elements themselves.

A distributor device made up of a combination of the traversing mechanism and of the distributor roller may be an integral part of an inking unit of the printing machine, the distributor roller being an ink distributor roller. If the distributor device is, instead, an integral part of a dampening unit of the printing machine, the distributor roller is a dampening-medium distributor roller.

Other features which are considered as characteristic for the invention are set forth in the appended claims.

Although the invention is illustrated and described herein as embodied in a combination of a distributor roller of a printing machine and a traversing mechanism for the distributor roller as well as an inking unit and a printing press having the combination, it is nevertheless not intended to be limited to the details shown, since various modifications and structural changes may be made therein without departing from the spirit of the invention and within the-scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 2:
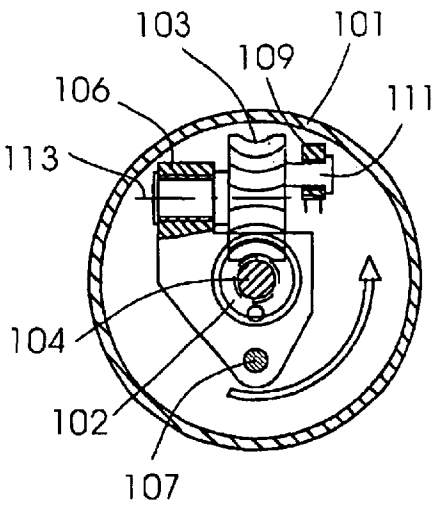
FIG. 2 is a cross-sectional view of FIG. 1 taken along the line II—II in the direction of the arrows.
Figure 1:
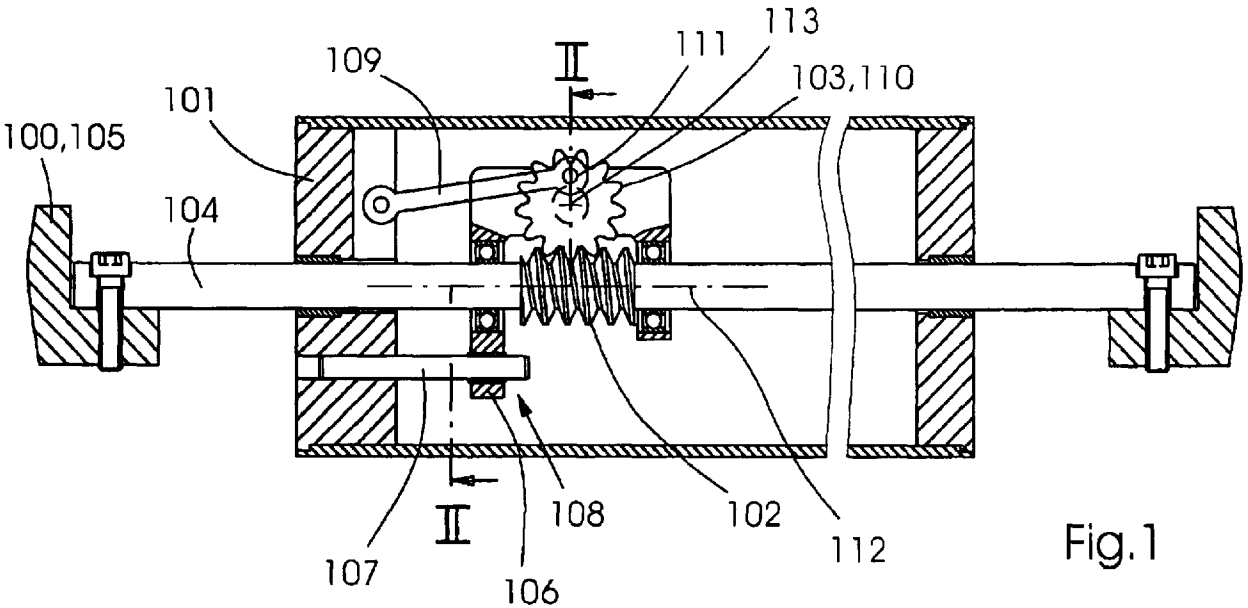
FIG. 1 is a diagrammatic, longitudinal-sectional view of a first embodiment of a distributor device according to the invention.
Figure 3:
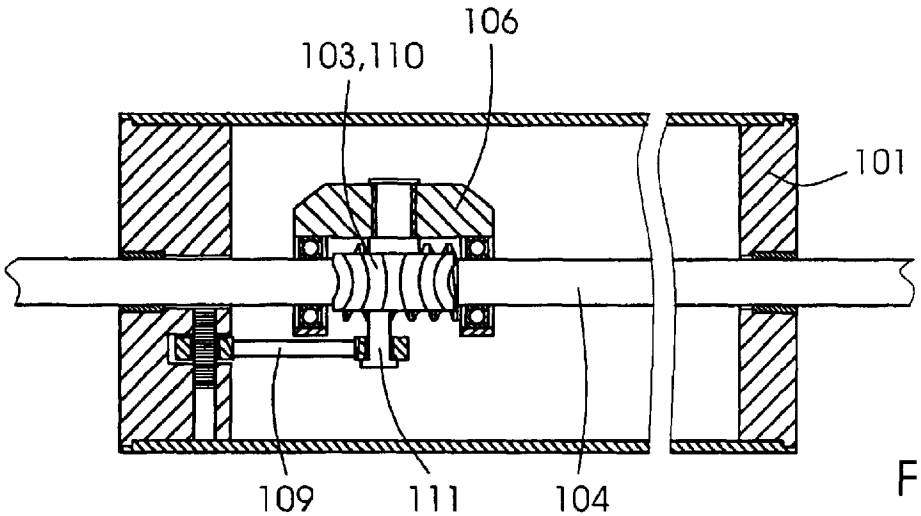
FIG. 3 is a longitudinal-sectional view of the first embodiment of the distributor device of FIG. 1, shown rotated 90° about the longitudinal axis thereof.

Referring now to the figures of the drawings in detail and first, particularly, to FIGS. 1 to 3 thereof, there is illustrated therein a portion of a printing machine 100. The illustrated detail shows an inking unit of the printing machine 100, which includes a non-illustrated applicator roller functioning as a drive roller of a distributor roller 101, and a distributor device which is a combination of the distributor roller 101 and a traversing mechanism for translatorily driving the distributor roller 101. A rotational movement is transmitted exclusively by friction to the distributor roller 101 by the circumferential surface of the rotating drive roller, which bears on the circumferential surface of the distributor roller 101.

The traversing mechanism includes worm gearing 102, 103 disposed in a cavity formed in the distributor roller 101, and a crank mechanism driven by the worm gearing 102, 103. The worm gearing is made up of an externally toothed worm 102 and a worm wheel 103 which meshes reciprocally with the worm 102.

Wheel axles 112 and 113, i.e., geometric middle axes, about which the worm 102 and the worm wheel 103 rotate, intercept one another.

The distributor roller 101 is mounted rotatably and displaceably in slide bearings on a shaft 104, whereon the worm 102 is seated fixed against rotation and sliding relative thereto, i.e., secured both against rotation around the shaft 104 and against displacement along the shaft 104. Each of two shaft ends of the shaft 104 is mounted in a respective lock 105 and is secured therein against rotation by a screw.

A web 106 revolving around the worm 102 is mounted by roller bearings on the shaft 104 so as to be rotatable about the latter and, is secured against displacement along the shaft 104 by non-illustrated guard rings, so that the worm wheel 103 is also secured against displacement in the longitudinal direction of the shaft 104 relative to the latter.

The term "web", within the scope of the description of this invention, serves solely for characterizing the technical gearing property of the component thus designated and is a term familiar in itself in the field of gear transmission technology, for example in connection with planetary gears.

A driver or entrainer 107 and a sliding joint 108 formed by the driver 107, together with a bushing, in the web 106 ensure a connection of the web 106 to the distributor roller 101, which is fixed against rotation relative to the distributor roller 101, with a simultaneous displaceability of the distributor roller 101 along the shaft 104, relative to the web 106. The sliding joint 108 is axially parallel to the shaft 104. The driver 107 is a pin and is connected to the distributor roller 101 by a firm fit or press fit, so that the driver 107 is immovable in relation to the distributor roller 101. A mutually exchanged, alternative configuration of the sliding joint 108 and of the firm fit is, of course, possible.

Disposed in the distributor roller 101 is a connecting rod (push-and-pull rod) 109 which is articulatedly connected, at one end, to the distributor roller 101 via a first rotary joint and, at the other end, via a second rotary joint, to a crank 110, likewise disposed in the distributor roller 101. The distributor roller 101, the connecting rod 109 and the crank 110 together form the crank mechanism which, to be precise, is a slider-crank mechanism. A crank pin 111 of the crank mechanism is inserted eccentrically into the worm wheel 103 which thus, in a multifunctional use, forms the crank 110.

The worm 102 is disposed between two legs of the web 106, each of the legs, respectively having one of the roller bearings inserted therein.

The first embodiment of the distributor device illustrated in FIGS. 1 to 3 and the appertaining traversing mechanism function as follows: a torque of the distributor roller 101 is transmitted to the web 106 via the driver 107, so that the web 106 and the worm wheel 103, together with the distributor roller 101, rotate about the stationary worm 102. In this regard, one tooth of the worm wheel 103 after the other meshes in a worm flight or auger of the worm 102, so that the worm wheel 103 rotates about the middle axis thereof.

Consequently, the crank pin ill also moves about the middle axis of the worm wheel 103, and the rotation of the worm wheel 103 is converted via the connecting rod 109 into a linear oscillation of the distributor roller 101 along the shaft 104. In this regard, the connecting rod 109 oscillates about the first rotary joint, by which the connecting rod 109 is connected at the end thereof opposite the crank pin 111 to the distributor roller 101. The movement of the connecting rod 109 results in a periodic variation in a distance existing between the middle axis of the worm wheel 103 and the first rotary joint. In other words, during the rotation of the crank mechanism around the worm 102, the distributor roller 101 is alternately pulled up against the web 106 and pushed away from the web 106 via the connecting rod 109, with the result that the distributor roller 101 moves along the shaft 104 alternately towards and away from the worm 102.

The worm gear or transmission made up of the worm 102 and the worm wheel 103 is constructed as a cylindrical worm gear or transmission, i.e., the worm 102 is a cylindrical worm, and the worm wheel 103 is a globoid wheel.

It may be mentioned in advance, at this juncture, that the worm gears of the second embodiment of the distributor device (FIGS. 4 to 6) and of the third embodiment of the distributor device (FIGS. 7 to 10) are also such cylindrical worm gears.

According to a non-illustrated, but conceivable, modification of the first embodiment of the distributor device illustrated in FIGS. 1 to 3, the driver 107 and the sliding joint 108 may be dispensed with. In this regard, the rotation of the distributor roller 101 is transmitted to the web 106 via the connecting rod 109, the crank pin 111 and the worm wheel 103.

The embodiment shown in FIGS. 1 to 3, however, has, in comparison with this just-mentioned modification, the advantages of higher distortion resistance and a lower stability requirement of the rotary joints of the connecting rod 109.

Figure 5:
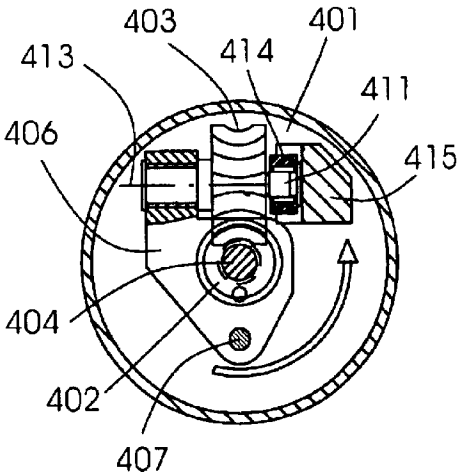
FIG. 5 is a cross-sectional view of FIG. 4 taken along the line V—V in the direction of the arrows.
Figure 4:
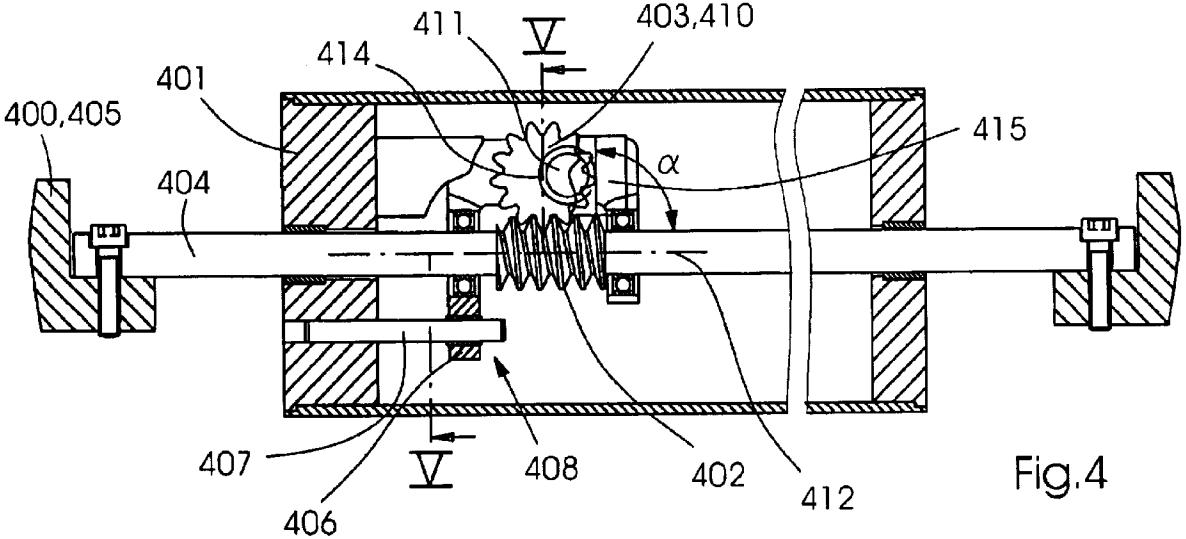
FIG. 4 is a view like that of FIG. 1 of a second embodiment of the distributor device.
Figure 6:
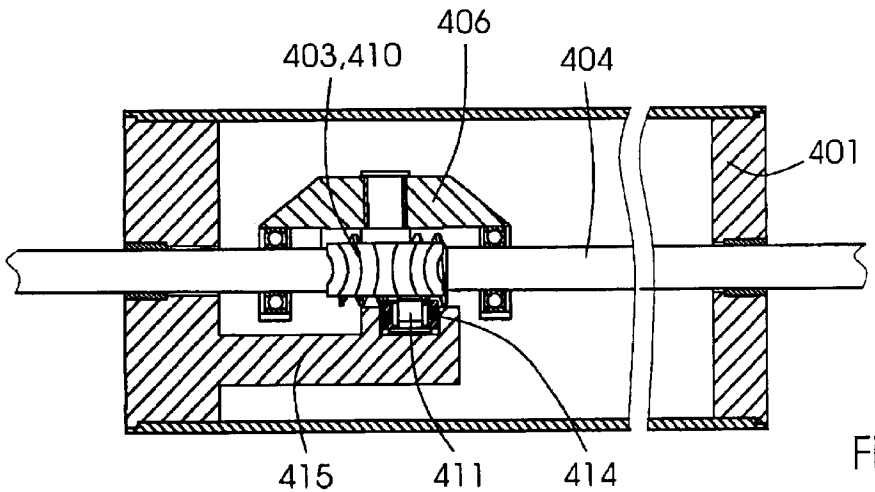
FIG. 6 is a view of the second embodiment of the distributor device of FIG. 4, shown rotated 90° about the longitudinal axis thereof.
Figure 8:
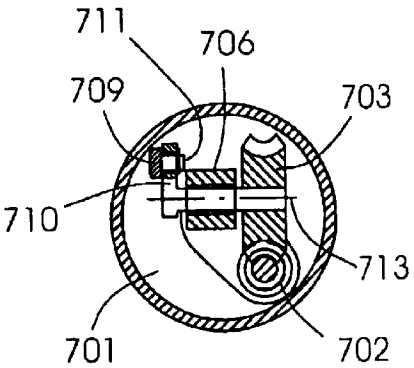
FIG. 8 is a cross-sectional view of FIG. 7 taken along the line VIII—VIII in the direction of the arrows.
Figure 9:
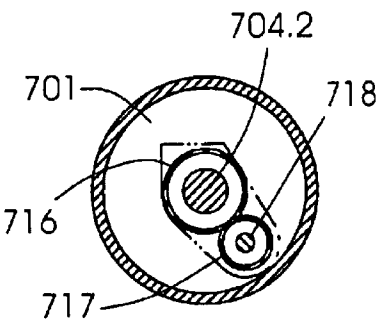
FIG. 9 is a cross-sectional view of FIG. 7 taken along the line IX—IX in the direction of the arrows.
Figure 7:
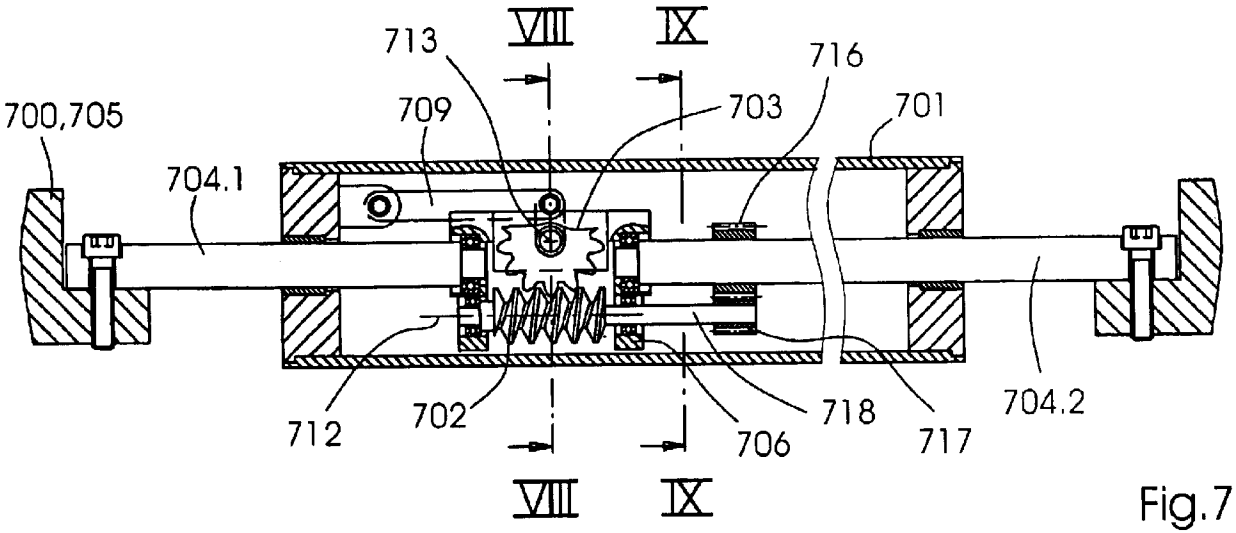
FIG. 7 is a view like those of FIGS. 1 and 4 of a third embodiment of the distributor device.
Figure 10:
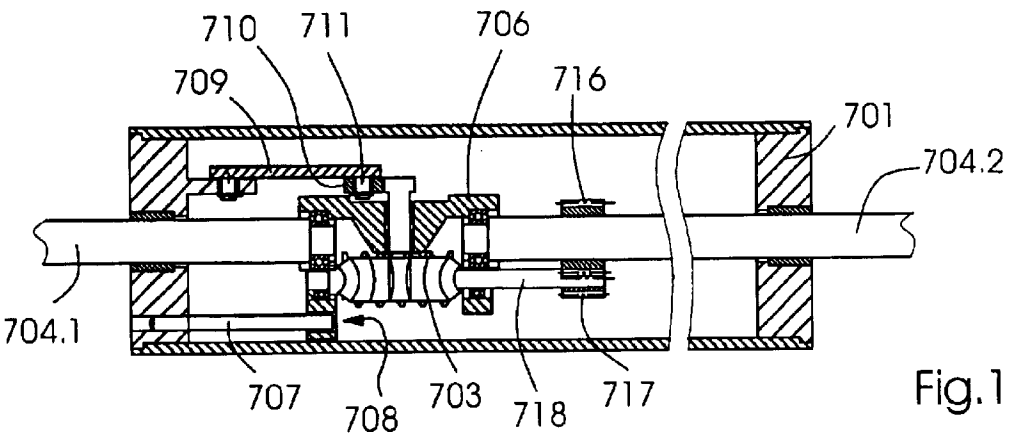
FIG. 10 is a view of the third embodiment of the distributor device of FIG. 7, shown rotated 90° about the longitudinal axis thereof.

FIGS. 4 to 6 illustrate a printing press or machine 400 with a second embodiment of the distributor device which includes a distributor roller 401 and, for the translatory drive of the latter, a traversing mechanism. A rotational movement is transmitted, exclusively by friction, to the distributor roller 401, by at least one non-illustrated circumferential surface bearing on the circumferential surface of the distributor roller 401.

The traversing mechanism includes a worm gear disposed in a cavity of the distributor roller 401, and a crank mechanism driven by this worm gear. The worm gear is made up of an externally toothed worm 402 and a worm wheel 403 meshing reciprocally with the worm 402.

A wheel axle 412 (geometric middle axis) about which the worm 402 rotates, and a wheel axle 413 about which the worm wheel 403 rotates are not oriented in parallel, but rather, perpendicular to one another.

The distributor roller 401 is mounted rotatably and displaceably, by slide bearings, on a shaft 404, whereon the worm 402 is seated so as to be fixed against rotation and sliding with respect to the shaft 404. The shaft 404 is secured, so as to be fixed against rotation, by screws at the two shaft ends thereof, which are respectively mounted in locks 405. A web 406 revolving around the worm 402 and having an at least approximately U-shaped profile is rotatably mounted on the shaft 404 by roller bearings, and fixed against sliding relative to the shaft 404 by non-illustrated guard rings, so that the worm wheel 403 is also secured against displacement along the shaft 404.

A driver 407 and a sliding joint 408 formed by the latter, together with a bushing, and extending axially parallel to the shaft 404 ensure a connection of the web 406 to the distributor roller 401, which is fixed against rotation relative thereto, while preserving a displaceability of the distributor roller 401 along the shaft 404 relative to the web 406. The driver 407 is a pin and is connected by a firm or press fit to the distributor roller 401, so that the driver 407 is immovable with respect to the distributor roller 401.

A mutually exchanged, alternative configuration of the sliding joint 408 and of the firm fit is, of course, possible.

A crank pin 411 is seated eccentrically in the worm wheel 403 which forms a crank 410, disposed in the distributor roller 401, of a crank mechanism, particularly a cross-slide crank mechanism. The cross-slide crank mechanism is made up of the crank 410, the crank pin 411, a slotted link or coulisse 415, a roller 414 mounted rotatably on the crank pin 411 and engaging in the slotted link 415, the distributor roller 401 and the shaft 404 which guides the distributor roller 401 during the reciprocating movement of the latter but which is itself stationary. The distributor roller 401 forms a first slide, which is mounted displaceably along the shaft 404, of the cross-slide crank mechanism, and the roller 414 forms a second slide, which is mounted displaceably along the slotted link 415, of the cross-slide crank mechanism. The roller 414 and, consequently, the crank pin 411 are guided linearly, by two guide tracks of the slotted link 415, which are located opposite one another, in a guiding direction which intersects the shaft 404 at an angle $\alpha$. To be precise, the angle $\alpha=90°$, so that the guiding direction is perpendicular to the shaft 404. The slotted link 415 forms, together with the roller 414, a rotary and sliding joint, via which the distributor roller 401 is coupled, in accordance with gear transmission technology, with the worm wheel 403.

An at least approximately parallelepipedal slotted-link block, for example a T-shaped tenon block or a slotted-link block having a dovetail profile, can, of course, be used, instead of the roller 414, as the second slide of the cross-slide crank mechanism. In this case, the distributor roller 401 would be coupled, in accordance with gear transmission technology, with the worm wheel 403 via a sliding joint (slotted-link 415/slotted-link-block pairing) and at least one rotary joint (slotted-link-block/crank-pin 411 pairing and/or crank-pin 411/crank 410 pairing), and the driver 405 can be dispensed with, if necessary or desirable.

The traversing mechanism of the second embodiment of the distributor device illustrated in FIGS. 4 to 6 differs functionally from the traversing mechanism of the first embodiment of the distributor device illustrated in FIGS. 1 to 3 only in that the axial reciprocatory movement of the distributor roller 401 is not derived from the movement of the crank pin 411 about the middle axis of the worm wheel 403 via an articulated connecting rod, but instead, via the slotted link 415 disposed on a side wall of the distributor roller 401 and projecting into the cavity formed in the latter.

FIGS. 7 to 10 illustrate a further printing machine 700 with a third embodiment of the distributor device including a distributor roller 701 and a traversing mechanism which moves the distributor roller 701 reciprocatingly in the axial direction of the latter. A rotational movement is transmitted to the distributor roller 701, exclusively by friction, by a non-illustrated circumferential surface bearing on the circumferential surface of the distributor roller 701.

The traversing mechanism includes a planetary gear mechanism and a worm gear, which are disposed in a cavity of the distributor roller 701, and a crank mechanism driven by the worm gear. The worm gear is made up of an externally toothed worm 702 and a worm wheel 703 meshing reciprocally with the worm 702.

A wheel axis 712 of the worm 702, and a wheel axis 713 of the worm wheel 703 are oriented crosswise.

The distributor roller 701 is mounted rotatably and displaceably, by slide bearings, on two journal-like shafts 704.1 and 704.2 which are mutually aligned. Each of the shafts 704.1 and 704.2 has an outer end held fixedly against rotation, respectively, in a lock 705, and an inner end connected to a web 706 via a roller bearing and provided with a shaft shoulder. The web 706 and, accordingly, also the worm wheel 703 are, in fact, mounted so as to be rotatable about the shafts 704.1 and 704.2 (due to the roller bearings), but are fixed against sliding on the shafts 704.1 and 704.2 (due to the shaft shoulders).

The planetary gear mechanism disposed in the distributor roller 701 has a single gear stage made up of two externally toothed gearwheels (spur wheels) meshing reciprocally with one another, more precisely a sun wheel 716 and a planet wheel or pinion 717. The sun wheel 716 is fastened on the shaft 704.2 so as to be fixedly against rotation and sliding relative to the shaft 704.2, and has a greater pitch diameter than that of the planet wheel 717. The planet wheel 717 and the worm 702 are seated on a shaft 718 rotatably mounted by roller bearings in the web 706. The shaft 718 connecting the planet wheel 717 and the worm 702 so as to be fixed against rotation relative thereto extends axially parallel to the shafts 704.1 and 704.2. The worm 702 is located between two legs of the web 706 which has an at least approximately fork-shaped profile, each of the legs, respectively, carrying one of the roller bearings.

The web 706 is connected, fixed against relative rotation, to a wall of the distributor roller 701 via a pin-shaped driver 707 and a sliding joint 708. The driver 707 serves for relieving the load on a connecting rod 709 of a crank mechanism, in particular a slide-crank mechanism, which is disposed inside the distributor roller 701. The connecting rod 709 is articulatedly connected at one end thereof to the distributor roller 701, and at the other end thereof, via a crank pin 711, to a crank 710 of the crank mechanism. The crank 710 and the worm wheel 703 are mounted coaxially with one another and rotatably in the web 706. Moreover, the crank 710 and the worm wheel 703 are connected, fixed against relative rotation, to one another.

In a non-illustrated modification or different embodiment, the driver 707 may be dispensed with, and a torque is transmitted to the web 706 by the distributor roller 701 via the connecting rod 709.

The traversing mechanism illustrated in FIGS. 7 to 10 functions as follows: A torque is transmitted to the web 706 by the distributor roller 701 via the driver 707, so that the web 706, together with the distributor roller 701, rotates about the shafts 704.1 and 704.2. Due to this rotation of the web 706, the shaft 718 revolves around the shaft 704.2 and, accordingly, the planet wheel 717 revolves around the central sun wheel 716.

Due to the meshing of the planet wheel 717 with the sun wheel 716 during the revolution of the planet wheel 717 around the sun wheel 716, the shaft 718 is set in rotation about itself, that is to say, for the purpose of a drive of the worm gear transmission resulting from the planetary gear mechanism, a moment of rotation or torque of the planet wheel 717 is transmitted to the worm 702 via the shaft 718. The worm 702, in turn, rotatively drives the worm wheel 703.

The crank pin 711 is connected to the worm wheel 703 via the crank 710, so that the crank pin 711 co-rotates with the worm wheel 703. Through the intermediary of the connecting rod 709, the rotation of the crank pin 711 about the common middle axis of the worm wheel 703 and the crank 710 is converted into a linear oscillation of the distributor roller 701 along the shafts 704.1 and 704.2 in relation to the web 706 and the worm gear.

Both the worm 702 and the worm wheel 703 rotatively driven by the worm 702 are located partially between the shafts 704.1 and 704.2. This configuration of the worm 702 and the worm wheel 703 between the shafts 704.1 and 704.2 affords a high degree of compactness of the components of the traversing mechanism, which have been integrated into the distributor roller 701, the compact components of the traversing mechanism being consequently particularly suitable for a distributor roller 701 having an outside diameter of very small dimension for functional reasons.

Although the planetary gear mechanism is a step-up gear transmission, wherein the planet wheel 717 executes more than one revolution about the mid-axis thereof during each revolution of the planet wheel 717 about the stationary sun wheel 716, a reduction (step-down to a low ratio) of the worm gear is selected so that the distributor roller 701 executes more than one revolution about the mid-axis thereof during each of the axial oscillation periods thereof. For example, the dividing gears (planetary gear transmission, worm gear transmission, crank mechanism) of the traversing mechanism (overall gear transmission) are constructed so that the distributor roller 701 executes exactly one axial oscillation during two and a half revolutions about the mid-axis thereof, so that an overall reduction amounts to 2.5 (and 2.5:1, respectively). The overall reduction may be within a range of 2 to 20 (preferably 3 to 18), depending upon the structural configuration. The overall gear transmission made up of the dividing gear transmissions is therefore a reduction gear transmission.

The latter fact also applies in a similar way to the traversing mechanisms (overall gear transmissions), which are illustrated in FIGS. 1 to 6, the overall reductions of which may also lie within the range of 5 to 20 (preferably 5 to 18).

Of course, in the traversing mechanism illustrated in FIGS. 7 to 10, a cross-slide crank mechanism may also be used instead of the slide-crank mechanism. For this purpose, it is merely necessary to replace the connecting rod 709 by a slotted link or coulisse wherein the crank pin 711 is guided. Such a substitution is already illustrated clearly by the example of the first and second distributor devices (FIGS. 1 to 6) and therefore is believed not to require any illustration again in connection with the third distributor device (FIGS. 7 to 10).

I claim:

1. In combination with a distributor roller of a printing machine, a traversing mechanism for the distributor roller having at least one shaft, comprising;

worm gearing having an externally toothed worm and a worm wheel meshing with said worm, said worm gearing being disposed in the distributor roller, and said worm and said worm wheel being mounted for rotation together about the at least one shaft of the distributor roller.

2. The combination according to claim 1, wherein said worm is disposed axially parallel to the distributor roller.

3. The combination according to claim 1, further comprising a planetary gear mechanism disposed in the distributor roller.

4. The combination according to claim 3, wherein said planetary gear mechanism is a single-stage spur-wheel planetary gear mechanism.

5. The combination according to claim 1, further comprising a crank mechanism having a crank disposed in the distributor roller.

6. The combination according to claim 5, wherein said crank mechanism is a cross-slide crank mechanism.

7. The combination according to claim 1, wherein the distributor roller is rotatably drivable by circumferential-surface friction.

8. In combination with a distributor roller of a printing machine, a traversing mechanism for the distributor roller, comprising:

worm gearing being disposed in the distributor roller and having an externally toothed worm and a worm wheel meshing with said worm, said worm wheel being mounted for rotation about said worm.

9. The combination according to claim 8, further comprising a cross-slide crank mechanism coupled with said worm gearing in accordance with gearing technology.

10. The combination according to claim 8, further comprising at least one stationary shaft, the distributor roller being rotatably mounted on said at least one stationary shaft.

11. An inking unit of a printing machine, comprising, in combination with an ink distributor roller having at least one shaft, a traversing mechanism for the ink distributor roller, the traversing mechanism including worm gearing having an externally toothed worm and a worm wheel meshing with said worm, said worm gearing being disposed in the ink distributor roller, and said worm and said worm wheel being mounted for rotation together about said at least one shaft of the distributor roller.

12. A printing press, comprising, in combination with a distributor roller having at least one shaft, a traversing mechanism for the distributor roller, the traversing mechanism including worm gearing having an externally toothed worm and a worm wheel meshing with said worm, said worm gearing being disposed in the distributor roller, and said worm and said worm wheel being mounted for rotation together about said at least one shaft of the distributor roller.

* * * * *